United States Patent [19]

Schwardt

[11] Patent Number: 4,531,929

[45] Date of Patent: Jul. 30, 1985

[54] APPARATUS FOR PRINTING, PUNCHING AND/OR CUTTING TO SIZE UNWOUND CARDBOARD PIECES

[75] Inventor: Manfred Schwardt, Reinfeld, Fed. Rep. of Germany

[73] Assignee: CORTEC, Wellpappenmaschinenhandelsund Service GmbH, Hamburg, Fed. Rep. of Germany

[21] Appl. No.: 524,246

[22] Filed: Aug. 17, 1983

[30] Foreign Application Priority Data

Aug. 19, 1982 [DE] Fed. Rep. of Germany ..... 3230833

[51] Int. Cl.[3] ..... B65H 13/12; B31B 1/04

[52] U.S. Cl. ..... 493/55; 101/183; 101/232; 271/197; 493/188; 493/320

[58] Field of Search ..... 101/232, 183; 271/197; 493/188, 55, 320

[56] References Cited

U.S. PATENT DOCUMENTS

| | | | |
|---|---|---|---|
| 2,083,351 | 6/1937 | Sidebothham | 493/55 |
| 3,368,461 | 2/1968 | Grobman | 493/55 |
| 3,648,605 | 3/1972 | Hottendorf | 493/55 |

FOREIGN PATENT DOCUMENTS

| | | |
|---|---|---|
| 1917650 | 4/1965 | Fed. Rep. of Germany . |
| 051761067 | 4/1972 | Fed. Rep. of Germany . |
| 052949957 | 3/1980 | Fed. Rep. of Germany . |

*Primary Examiner*—W. D. Bray

*Attorney, Agent, or Firm*—Schmidt, Johnson, Hovey & Williams

[57] ABSTRACT

An apparatus for performing a manufacturing operation on a plurality of flat sheets, such as corrogated cardboard, is provided which is quickly and easily configured for the desired manufacturing operation and substantially reduces the makeready times between jobs having different manufacturing requirements. Preferably, the apparatus includes a mechanism for transporting the sheets serially along a path of travel from the stack of sheets to a first manufacturing location. A mechanism for performing the desired manufacturing operation is normally disposed at the first location, but is shiftable out of the first location when desired. Advantageously, a shiftable conveying mechanism is provided which is shifted into the first location when the manufacturing mechanism is shifted out. Preferably, the apparatus includes a second shiftable manufacturing mechanism and a second shiftable conveying mechanism operably disposed adjacent a second location along the path of travel. Advantageously, the first and second mechanisms can operate either simultaneously on the serially moving sheets, or one of the mechanisms can be shifted out of its manufacturing location for maintenance purposes or to set up for a different job without stopping the apparatus for long periods of time.

22 Claims, 10 Drawing Figures

Fig. 9
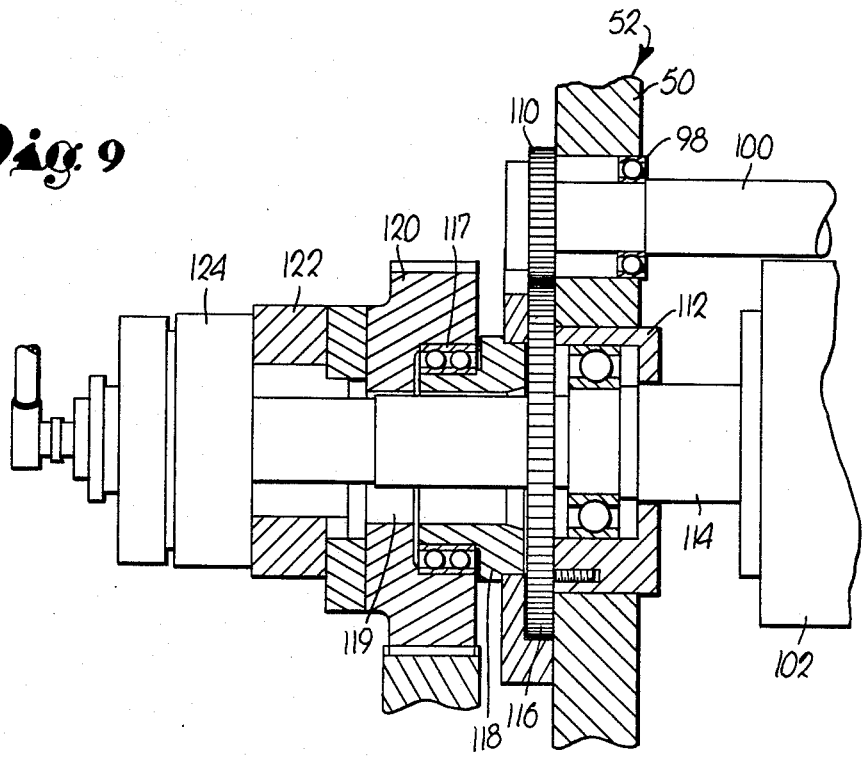
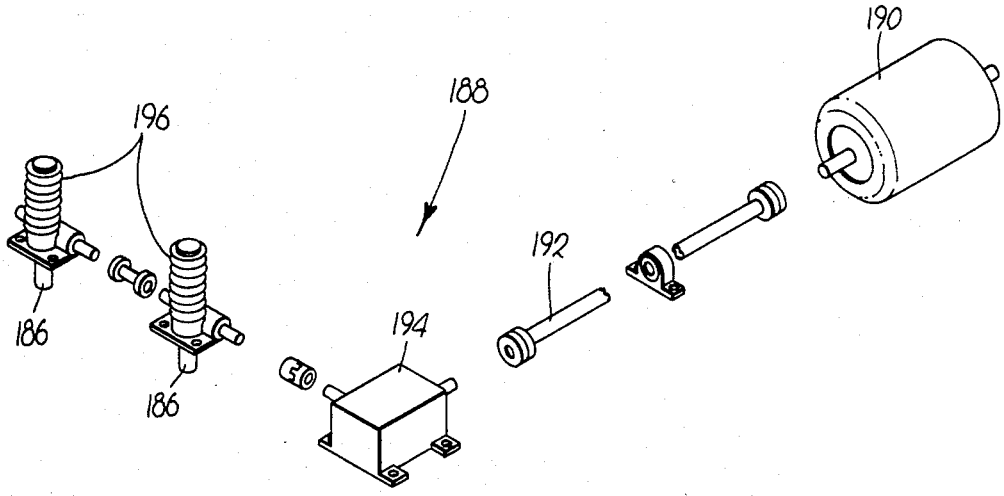
Fig. 10

APPARATUS FOR PRINTING, PUNCHING AND/OR CUTTING TO SIZE UNWOUND CARDBOARD PIECES

BACKGROUND OF THE INVENTION

1. Field of the Invention

This invention relates generally to an apparatus for performing a manufacturing operation on a plurality of flat sheets, such as corrogated cardboard, moving serially along a path of travel through the apparatus, and includes numerous advantages such as ease of maintenance and a substantial reduction in the makeready times between jobs having different manufacturing requirements. More particularly, it is concerned with an appartus having a mechanism for transporting the sheets, a mechanism for performing the desired manufacturing operation which is shiftable out of the manufacturing location, and a shiftable conveying mechanism which is easily shiftable into the manufacturing location for facilitating continuous flow of the sheets through the apparatus when the manufacturing mechanism is shifted out of the manufacturing location.

2. DESCRIPTION OF THE PRIOR ART

Many people will appreciate that the cost of packaging a particular product can comprise a large percentage of the overall cost of the product. Packaging costs have risen particularly over the last decade as a result of changes in selling practices of merchants and the purchasing preferences of consumers. That is, there has been a trend in recent years towards self-service in the retail trade which has in turn, necessitated a change in packaging requirements. Thus, in a self-service type retail market, it is important that the packaging give the product adequate display potential (e.g. stackability) and perhaps more importantly the packaging must help sell the product.

The display potential requirement of current packaging often necessitates that the packaging material be rigid to allow for stackability. A readily apparent answer to the rigidity requirement is the use of corrogated board, and indeed, fine flute and micro flute corrogated board has gained widespread popularity in recent years.

Because the packaging material must help sell the product, the package must not only be of an aesthetically pleasing design, but also frequently incorporates more elaborate pictorial and written material. To meet these needs, there has been a large increase in the packaging industry in the use of printed corrogated board sheets, variously known under the rubrics "offset printed corrogated board", "value-added corrogated board", or "litho-laminated corrogated board".

Several methods have been used in the past for producing such corrogated board, but all have been deficient in a number of respects. For example, one such method laminates printed sheets to corrogated board sheets while a variation of this method laminates preprinted sheets to continuously moving corrogated board web. These methods have been effective in that heretofore it has typically been easier to offset print thin, quality paper sheets and then laminate sheets to corrogated board. Although the quality of such a package is high, the expense is correspondingly high. Another method is illustrated in U.S. Pat. No. 3,648,605 in which two printing mechanism are arranged along a conveyor to print corrogated sheets as they are fed therethrough. A problem that has existed with such past methods and associated devices is that they all suffer from the substantial makeready times required for changeover to a different job. That is, machines heretofore used to manufacture corrogated board all suffer from the disadvantage that the feed, printing, punching and cutting mechanisms are driven by the same power transmission. While it is desirable to drive the various manufacturing mechanisms by the same powertransmission for synchronization purposes, the undesirable result is that all of the mechanism must be stopped if it is necessary to work on only one mechanism, thereby stopping operation of the complete installation. For example, if it is desired to change the punching pattern in the corrogated board for the particular job requirements, it is necessary to stop the complete installation to perform the changeover on the punching mechanism. Still another example, is the work stoppage necessary to change the printing imprint on the corrogated board. That is, to change the color or imprint it is necessary to stop the entire installation while the printing plates or mats are changed on the blanket and plate rollers. Although a number of different types of manufacturing mechanism have been proposed which are in some way shiftable out of the manufacturing position, they all suffer from the common defect in that the entire installation must be stopped while the changeover is effected on the particular manufacturing mechanism. Thus, it would be an advance in the art if work or changeover could be performed on a particular manufacturing mechanism without shutting down the entire installation for the entire time period required for the work or changeover.

SUMMARY OF THE INVENTION

The problems outlined above are in large measure solved by the manufacturing apparatus of the present invention in that the manufacturing operation need not be stopped while work if performed on a particular manufacturing mechanism. The apparatus hereof is particularly useful for performing a manufacturing operation on a plurality of flat sheets (such as corrogated board) serially moving along a path of travel. The apparatus hereof contemplates that the manufacturing installation would be not stopped or stopped only momentarily, when it is necessary to work on a particular manufacturing mechanism.

The manufacturing apparatus of the present invention broadly includes means for transporting the separated sheets serially along the path of travel between a sheet entry point and a first location and between the first location and a sheet exit point. Additionally, the apparatus includes work means disposed along the path of travel normally at the first location, with the work means operable for moving the sheets along the path of travel at the first location and for performing the desired manufacturing operation on each sheet as it passes the first location. Advantageously, the work means is shiftable from the first location to a second location, with the work means not performing the particular manufacturing operation when in the second location. Finally, the manufacturing apparatus hereof includes conveying means disposed along the path of travel and shiftable to the first location when the work means is shifted into its second location. Thus, the conveying means moves the sheets along the path of travel at the first location when the work means is in the second location.

It will be appreciated that the work means could be any of a variety of manufacturing mechanisms associated with manufacturing corrogated board. For example, the work means can be a punching mechanism, cutting mechanism, or perhaps most commonly a printing mechanism. In particularly preferred forms, the work means entails two or more offset printing mechanisms spaced along the path of travel with the conveying means comprising a pair of juxtaposed rollers operatively coupled to the respective printing mechanism. Thus, if two printing mechanisms are present, one printing mechanism can be operatively positioned along the path of travel for printing the corrogated board in which case the associated conveying rollers would in inoperative. However, the other printing mechanism might be shifted away from the path of travel, in which case the conveying rollers are operatively disposed in the path of travel for moving the corrogated board at that location. With the printing mechanism away from the path of travel, various maintenance functions can be performed thereon, or advantageously, the printing mechanism can be reconfigured for the next job. It should be appreciated, that both printing mechanisms can be operatively disposed in the path of travel for two color printing on the corrogated board, or for that matter, multiple printing mechanisms can be incorporated for multi-color printing. Although the manufacturing apparatus of the present invention is equally operable on corrogated web or corrogated sheets, the preferred embodiment contemplates operation on a plurality of corrogated sheets serially moving along the path of travel.

BRIEF DESCRIPTION OF THE DRAWING

FIG. 9 is a fragmentary sectional view of the pneumatic clutch and eccentric adjustment mechanism from the impression cylinder of the invention hereof; and FIG. 10 is a perspective view of the raising device for one side of the printing mechanism hereof, with parts exploded for clarity.

DESCRIPTION OF THE PREFERRED EMBODIMENT

Figure 1:
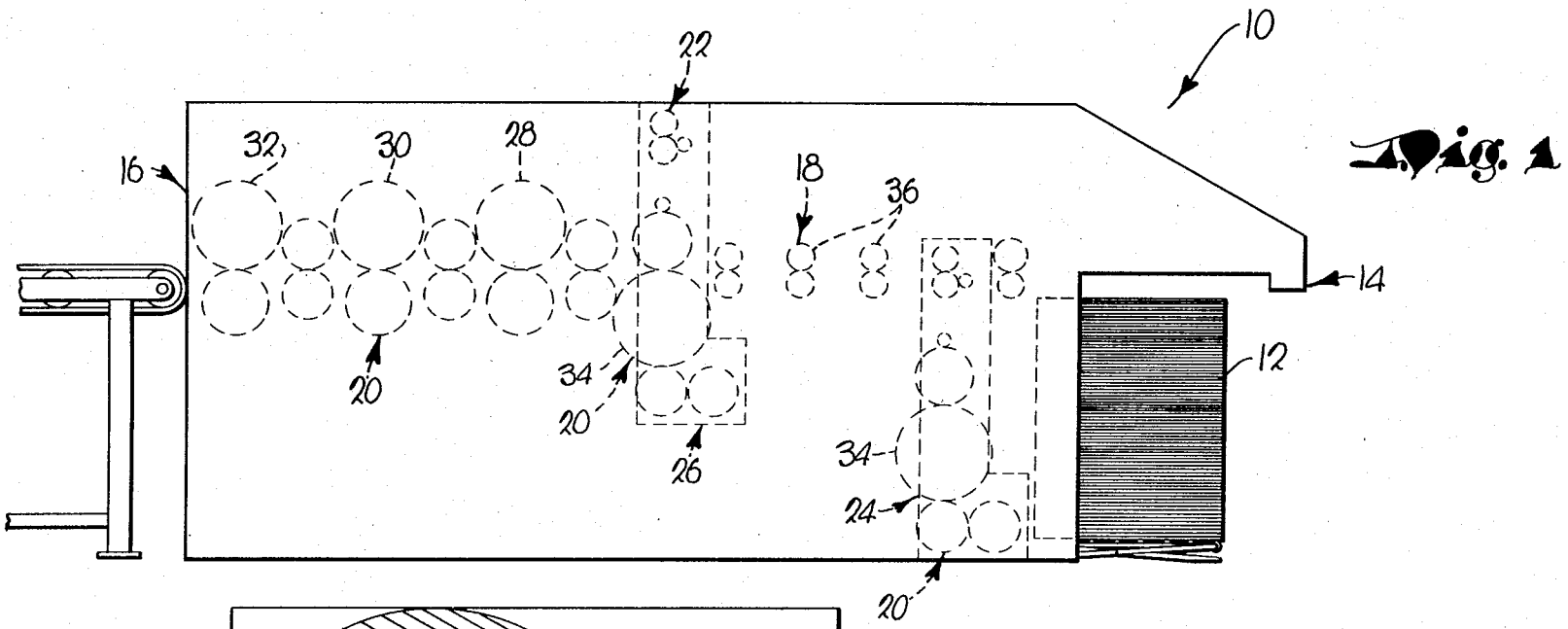
FIG. 1 is a schematic view of the preferred manufacturing apparatus in accordance with the present invention.

Turning now to the drawings, a manufacturing apparatus 10 in accordance with the invention is illustrated (see FIG. 1). The apparatus 10 of the preferred embodiment is specifically designed to perform a manufacturing operation on a plurality of generally flat, separated corrogated sheets 12. In FIG. 1, the sheets 12 are shown in a stack adjacent the feed end 14 for serial flow through the apparatus 10 to the delivery end 16. Generally speaking, the apparatus 10 includes a transportation means 18 for transporting the separated sheets 12 serially along a path of travel, a plurality of work means 20 spaced sequentially along the path of travel through the apparatus 10 for performing the desired manufacturing operations, and conveying means 22 shiftably disposed along the path of travel.

In more detail, referring to FIG. 1, it is readily appreciated that a number of different manufacturing locations are operatively disposed along the path of travel, with each location providing a site for a work means 20. Thus, sequentially spaced from the feed end 14 to the delivery end 16 are a pluraity of work means 20 presenting a first print station 24, a second print station 26, a punching station 28 and cutting stations 30, 32. In the preferred embodiment, each printing station 24, 26 presents a lowermost printing mechanism 34 operatively coupled to the shiftable conveying means 22.

The transportation means 18 of the preferred embodiment presents a pluraity of elongated parallel juxtaposed shaft pairs 36, with the path of travel of the sheets 12 passing through the nip between the respective shaft pairs 36. As can be appreciated, the shaft pairs 36 are spaced apart as necessary to provide movement of the sheets 12 along the path of travel between adjacent saft pairs 36. As illustrated in FIG. 1, each printing station 24, 26 is vertically shiftable between a printing position and a conveying position. That is, as shown in FIG. 1, the second printing station 26 is upwardly shifted into a printing position whereby the printing mechanism 34 is operatively disposed along the path of travel for printing the serially moving sheets 12. The first printing station 24 is shown in FIG. 1 in its lowermost conveying position. Thus, the printing mechanism 34 of the print station 24 is rendered inoperable in the lowermost position and the shiftable conveying means 22 is shifted into place in the path of travel to maintain the movement of the sheets 12 through the apparatus 10. Those skilled in the art will appreciate that with the print mechanism 34 of the first print station 24 rendered inoperable, as shown in FIG. 1, maintenance functions can be performed on the print mechanism 34 and/or the printing plate or blanket mat can be changed over to the requirements for the next printing job, without the necessity of stopping the operation of the apparatus 10.

Figure 6:
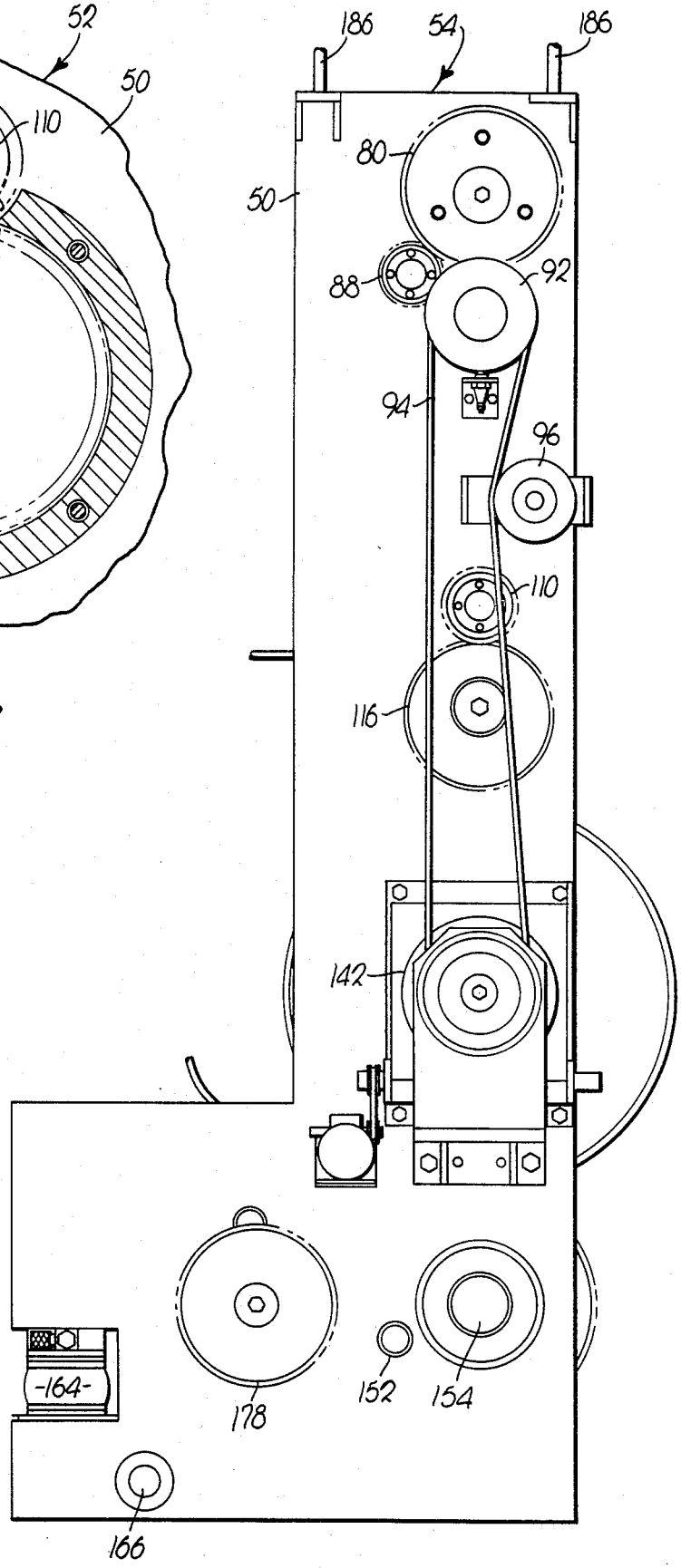
FIG. 6 is a side elevational view of the work side of the printing mechanism of the present invention.
Figure 7:
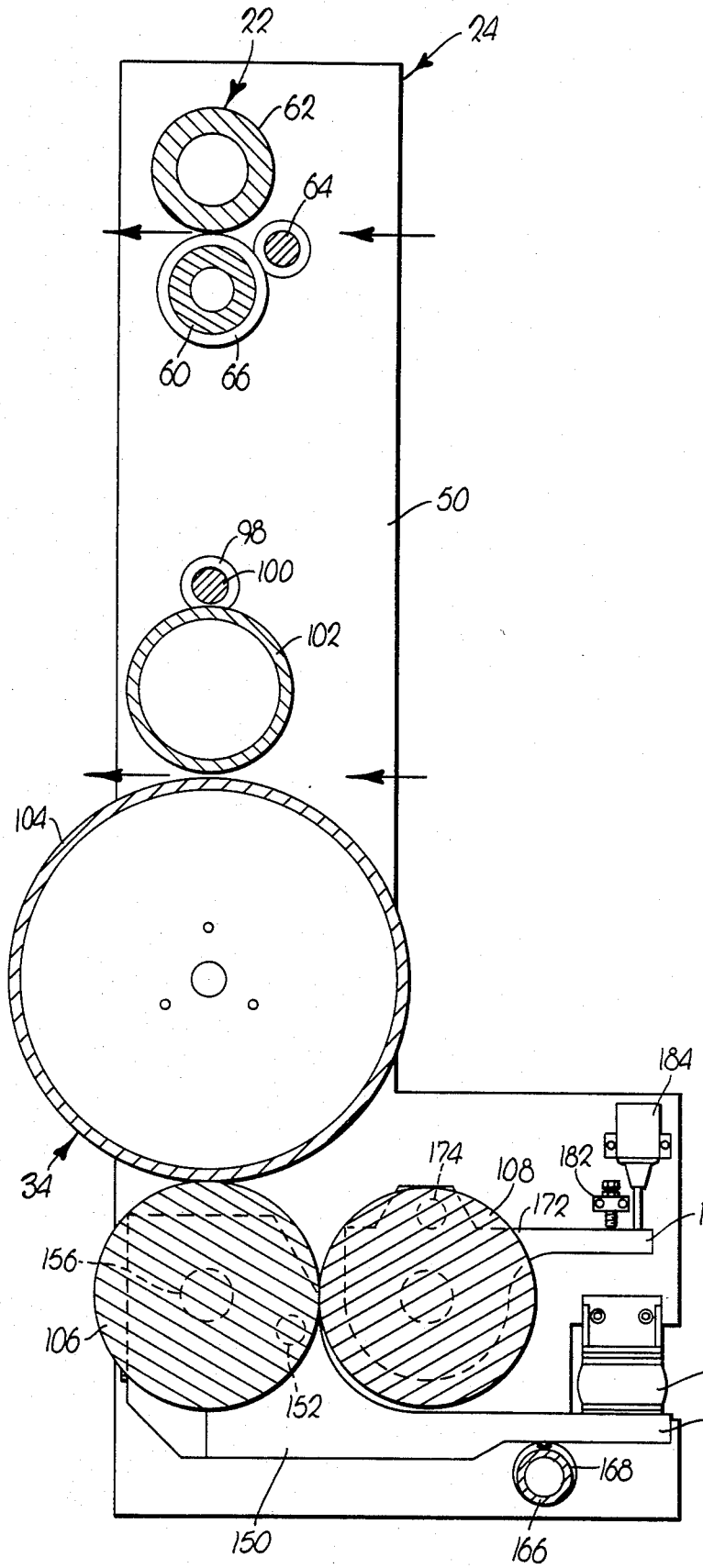
FIG. 7 is a vertical sectional view of the printing mechanism of the present invention and illustrates in phantom the mounting arms of the plate and inking cylinders.
Figure 8:
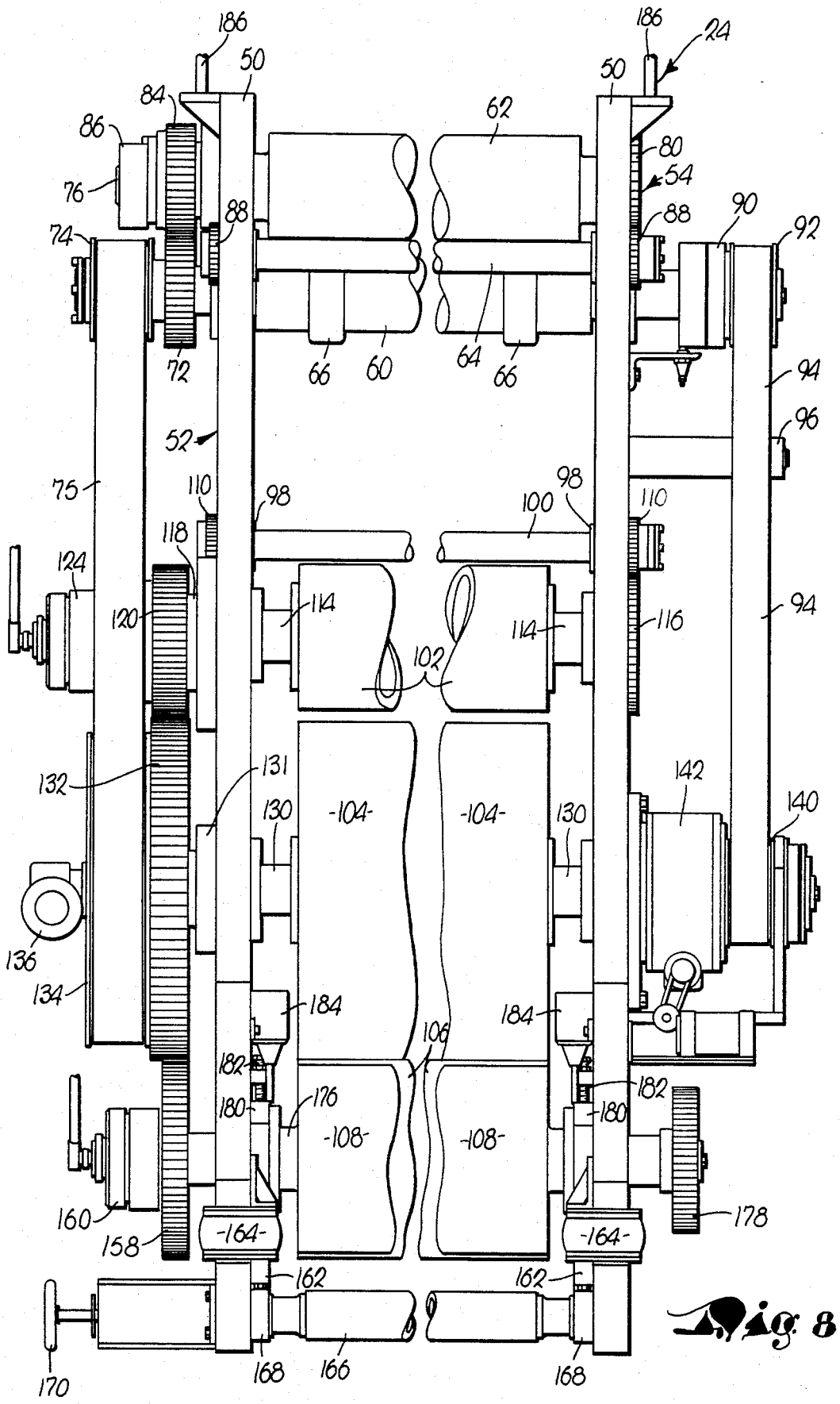
FIG. 8 is a fragmentary elevational view of the printing mechanism hereof.

Turning now to FIGS. 2–9, the printing station of the apparatus 10 is illustrated in detail. As printing stations 24 and 26 are identical in all respects, it is understood that the description herein of printing station 24 is equally applicable to printing station 26. As previously mentioned, the printing station 24 broadly includes a lowermost printing mechanism 34 and an uppermost conveying means 22. A pair of upright, vertically oriented spaced apart side frames 50 operably support the respective conveying means 22 and print mechanism 34. As can be seen in FIG. 8, the overall configuration of the side frames 50, conveying means 22 and print mechanism 34 presents a gear side 52 and a work side 54.

Broadly speaking, the conveying means 22 of the print mechanism 34 presents a lowermost driving cylinder 60 oriented parallel with an uppermost driven cylinder 62. Oriented towards the feed end of the apparatus 20 is an elongated adjustment roller 64 disposed approximately adjacent the nip between the cylinders 60, 62. Advantageously, the driving cylinder 60 has a plurality of spaced apart arcuate rubber donuts 66 affixed thereto (see FIG. 8).

Figure 3:
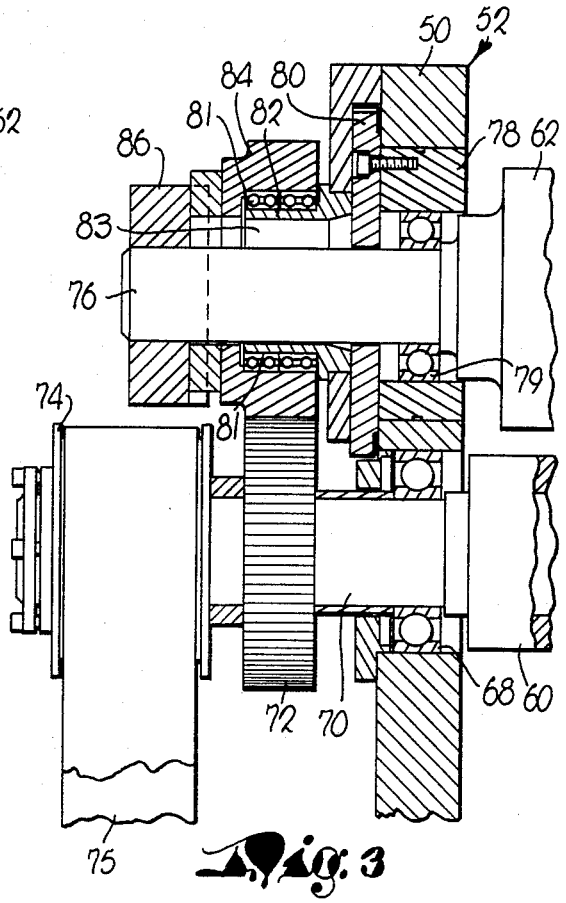
FIG. 3 is a fragmentary sectional view of portions of the drive transmission for the conveying mechanism.
Figure 4:
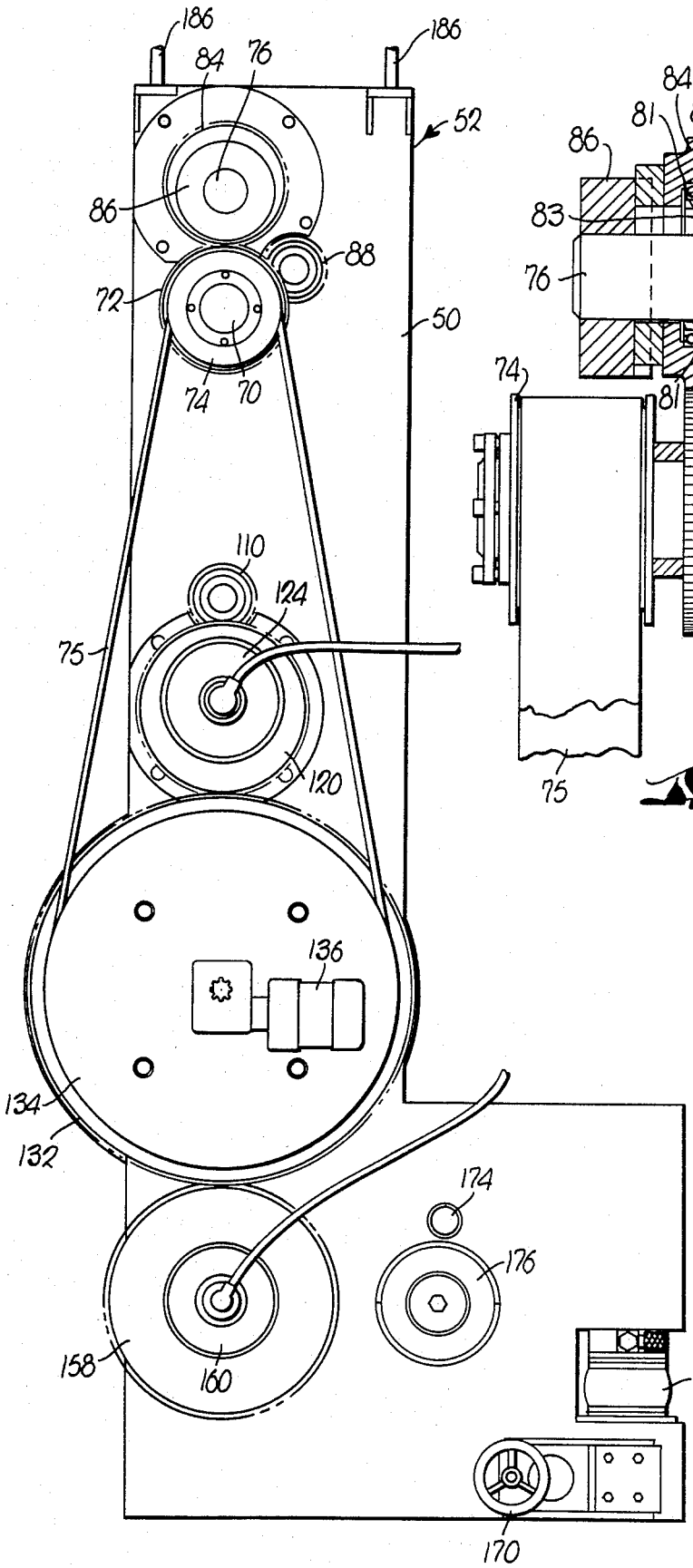
FIG. 4 is a side elevational view of the gear side of the printing mechanism of the present invention.
Figure 5:
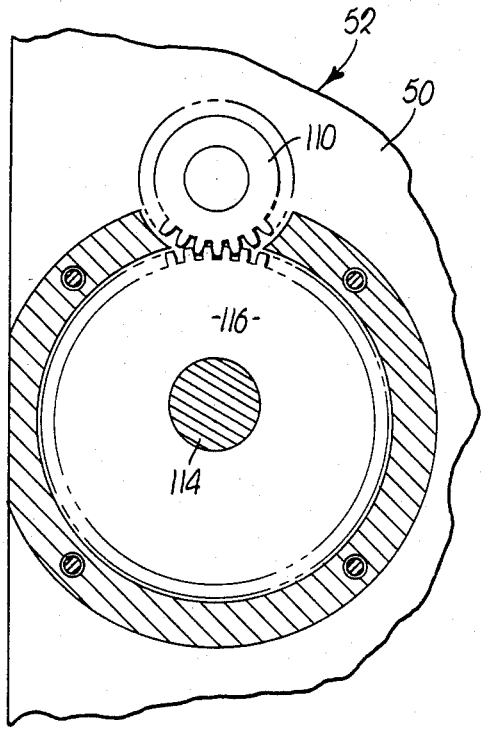
FIG. 5 is a fragmentary sectional view of the adjustment roller and impression roller of the present invention.

Turning now to the gear side 52 of the conveying means 22, cylinders 60, 62 are mounted in conventional fashion; that is, driving cylinder 60 is mounted in a fixed location in side frame 50, while driven cylinder 62 is adjustable either towards or away from the driving cylinder 60. It will be appreciated that the adjustability of cylinder 62 allows the optimum feeding of the sheets 12 through the nip between the cylinder 60, 62 (see FIG. 7). Turning to FIGS. 3, 4, and 8, the driving cylinder 60 presents an elongated, cylindrical shaft 70 at each distal end thereof, with each shaft 70 mounted to the respective side frame 50 using a conventional bearing assembly. For example, the driving cylinder 60 is mounted in the side frame 50 of the gear side 52 by means of a bearing assembly 69 enveloping the shaft 70 of the cylinder 60. Outboard of the side frame 50, a driving gear 72 is secured to the shaft 70, while a pulley 74 is secured to the distal end of the shaft 70. Advantageously, a flat belt 75 is operatively looped around the pulley 74 for purposes which will be made clear.

The driven cylinder 62 is adjustably mounted in the respective side frames 50, and to this end, cylinder 62 presents an elongated cylindrical shaft 76 at each end thereof, with each shaft 76 mounted in the respective side frame 50 by way of an eccentric bearing assembly. For example, turning to the gear side 52 (see FIG. 3) side frame 50 is apertured to receive an eccentric ring 78 which is rotatably received within the side frame 50. Shaft 76 is held by bearing 79 within the eccentric ring 78, allowing shaft 76 to freely rotate relative ring 78. Outboard of the bearing 79 an adjustment gear 80 is secured to the eccentric ring 78 (using cap screws) and is apertured to receive the shaft 76 freely therethrough. A journal assembly 82 is secured to the side frame 50 overlying the adjustment gear 80 and presents an outermost bearing surface 81 for rotatably mounting a driven gear 84 and an innermost, somewhat enlarged aperture 83 axially extending therethrough (see FIG. 3). It will be appreciated, that the shaft 76 has a smaller diameter than aperture 83, allowing the shaft 76 to be repositioned within the aperture 83 while the journal 82 remains stationary. Thus, the driven gear 84 mounted on journal 82 rotates in a fixed location to remain in operative mesh with the driving gear 72. Fixedly secured to the distal end of the shaft 76 is a shiftable coupler 86 operatively connected the shaft 76 to the gear 84, and presenting an inboard key assembly operatively received in a complemental groove assembly of the driven gear 84. Advantageously, this key-groove interfitting between the coupler 86 and driven gear 84 allows the coupler 86 to move relative the driven gear 84 while maintaining drive transmission. Shaft 76 also presents a key-groove assembly (not shown) adjacent the distal end thereof oriented approximately orthogonally to the key groove interconnection between the driven gear 84 and coupler 86. It will be appreciated, that this structure allows the driven cylinder 62 to be powered via the driven gear 84, coupler 86, and shaft 76, irregardless of the position of the shaft 76 within journal 82.

Figure 2:
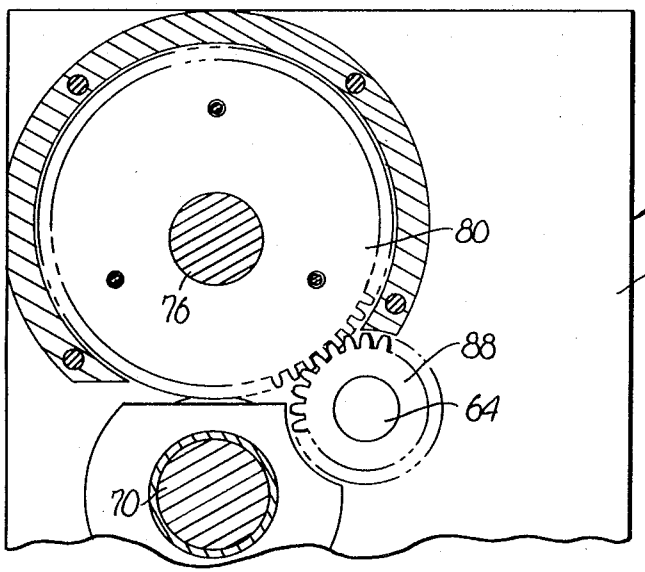
FIG. 2 is a fragmentary sectional view of portions of the conveying mechanism of the present invention.

The adjustment roller 64 advantageously presents an adjustment gear 88 at each distal end thereof just outboard of the respective side frame 50 (see FIG. 2). The adjustment gear 88 is in constant operative mesh with the adjusting gear 80, such that rotation of the adjusting roller 64 affects corresponding rotation of the adjusting gears 88, 80, thereby rotating the eccentric ring 78 within the side frame 50. It should be appreciated that the work side 54 presents the same eccentric features of the gear side 52, without the necessity of the power transmission structure as hereinabove described (see FIG. 8).

Turning now to FIGS. 6, 8, it is readily apparent that the shaft 70 of the driving cylinder 60 extends well beyond the side frame 50 of the work side 54 of the print station 24. Secured to the distal end of the shaft 70 on the work side 54 is an electromagnetic clutch assembly 90 of the conventional variety. To this end, a pulley 92 is retained about the distal end of the shaft 70 outboard the clutch assembly 90. When the clutch assembly 90 is activated, the pulley 90 transitions from freewheeling about the shaft 70 to a state where it is driven by the clutch assembly 90 corresponding to rotation of the shaft 70. A flat, power transmission belt 94 is operatively looped around pulley 92 for purposes which will be made clear. Advantageously, a belt tensioning device 96 is mounted to side frame 50 in engagement with belt 94.

Turning now to the printing mechanism 34, operatively mounted between the respective side frames 50 (top to bottom as seen in FIGS. 7–8) are adjustment roller 100, impression cylinder 102, enlarged blanket cylinder 104, and plate or screen cylinder 106, with the rotational axes of the roller 100 and cylinders 102–106 being approximately vertically aligned. Disposed in general juxtaposition to the plate cylinder 106 towards the feed end 14 of the apparatus 10 is a conventional inking and dampening cylinder 108. Thus, the printing mechanism 34 presents structure for conventional offset lithography, with the path of travel of the sheets 12 through the print mechanism 34 passing through the nip between the impression cylinder 102 and blanket cylinder 104 (see FIG. 7).

As those skilled in the art will appreciate, the impression cylinder 102 is adjustable relative the blanket cylinder 104, and to this end, the impression cylinder 102 is eccentrically mounted in its respective side frames 50 in much the same manner as the eccentric mounting of the driving cylinder 60 of the conveying means 22. For example, turning to FIGS. 5, 8, 9 the side frame 50 of the gear side 52 is apertured for mounting a bearing 98 therein for the operative reception of the adjustment roller 100 (see FIG. 9). Each distal end of the adjustment roller 100 presents an adjustment gear 110 secured thereto. Directly beneath the adjustment roller 100, the side frame 50 is apertured for the rotational reception of eccentric ring 112. The eccentric ring 112 presents a bearing on the inner surface thereof for the operative reception of shaft 114 of the impression cylinder 102. Fixedly secured to the eccentric 112 is an adjustment gear 116 operatively receiving the shaft 114 therethrough and in operative mesh with the adjustment gear 110 of the adjustment roller 100. Outboard of the gear 116, a journal assembly 118 is fixedly secured to the side frame 50 and overlays gear 116 (see FIG. 9).

The outermost circumferential surface of the journal 118 presents a roller bearing arrangement 117, while the journal 118 presents an enlarged axial aperture 119 extending therethrough. A driven gear 120 is operatively mounted on bearing 117, while shaft 114 is received in aperture 119 (compare FIGS. 8 and 9). A coupler 122 is operatively secured to the driven gear 120 by a key and groove arrangement to allow relative movement of a coupler 122 to the gear 120, while maintaining rotational engagement. Additionally, the distal end of shaft 114 is split and interconnected by a key and groove arrangement to allow relative movement between the parts of the shaft 114. A pneumatic clutch 124 operatively interconnects the coupler 122 and the shaft 114 such that upon actuation of the clutch 124, rotational movement of the gear 120 in turn drives the shaft 114. It will be appreciated that this rotational operative engagement between the shaft 114 and gear 120 is maintained no matter what the position the impression cylinder 102 is placed in by the eccentric ring 112. Thus, rotation of the adjustment roller 100 will eccentrically reposition the impression cylinder 102, while the pneumatic clutch 124 allows the impression cylinder 102 to be driven or rendered inoperable as desired.

Turning now to the blanket cylinder 104, it will be appreciated that the blanket cylinder is not eccentrically mounted in the side frames 50, but rather presents a shaft 130 at each end thereof extending through stationary bearings (not shown) in the respective side frames 50. On the gear side 52, outboard of the respective side frame 50, an elongated, apertured sleeve 131 is fixedly secured to the side frame 50 (see FIG. 8). An enlarged, circular in cross-section driving gear 132 is rotatably mounted on the sleeve 131. Just outboard of the driving gear 132, an enlarged, circular in cross-section pulley 134 is fixedly secured to the gear 132. The belt 75 is operatively looped around pulley 134, thereby interconnecting pulleys 134 and 74. Advantageously, the sleeve operatively receives the shaft 130 (via a telescoping interconnection) to allow slight axial movement of the shaft 130 within the sleeve 131. To this end, an adjustment structure 136 comprising an electric motor and a worm screw type arrangement is secured to sleeve 131 and operatively coupled to the shaft 130. Thus, operation of the adjustment structure 136 will axially shift the shaft 130 and correspondingly the blanket cylinder 104, as may be necessary to improve printing quality.

Turning to the work side 54 of the blanket cylinder 104, the shaft 130 extends through the respective side frame 50 through an appropriate bearing in much the same manner as the gear side 52. The distal end of the shaft 130 on the work side 54 presents a pulley 140 and the belt 94 is operatively looped around pulley 94. Intermediate the side frame 50 and pulley 140 is a radial adjustment mechanism 142 of the conventional variety. Thus, the radial adjustment mechanism 142 allows the blanket cylinder 104 to be radially adjusted to improve print quality.

Turning now to the mounting of the plate cylinder 106 to the side frames 50, (see FIGS. 7–8), it should be appreciated that the plate cylinder 106 is shiftably mounted to the side frames 50 for adjustment purposes. To this end, a mounting arm 150 is secured to each side frame 50 and is pivotal about a pivot point 152 (see FIG. 7). The shaft 154 of the plate cylinder 106 is rotationally mounted in a bearing 156 received in the respective mounting arm 150. Each side frame 50 presents an enlarged opening therethrough in which the shaft 154 extends in spaced relation. Turning to the gear side 52, a driven gear 158 is rotatably mounted on the shaft 154 with a pneumatic clutch 160 interconnecting the driven gear 158 and the shaft 154. Advantageously, the clutch 160 allows the plate cylinder 106 to be selectively driven by the gear 158 or decoupled as desired. On the work side 54, the shaft 154 extends beyond the side frame 50 and includes a gear (not shown) fixedly secured thereto.

Turning to FIG. 7, the mounting arm 150 presents an elongated lever portion 162 extending towards the feed end 14 of the apparatus 10. A pneumatic bellows 164 is secured to the side frame 50 and downwardly biases the lever 162 of the mounting arm 150. An elongated cylindrical adjustment roller 166 extends between the respective side frames 50 disposed beneath the respective levers 162 of the mounting arms 150. The adjustment roller 166 presents an eccentric surface 168 inboard relative each side frame 50 and in operative contact with the underneath side of the respective levers 162. A turn wheel 170 is provided on the gear side 52 in operable connection to the adjustment roller 166 such that operating the turnwheel 170 repositions the eccentric surfaces 168 of the adjustment roller 166. It will be appreciated that this arrangement allows the respective mounting arms 150 to pivot relative the pivot point 152 with the result of fine adjustment of the pressures between the respective blanket cylinder 104 and plate cylinder 106.

Turning to the inking cylinder arrangement 108, it will be seen that the inking cylinder 108 is adjustably mounted in the side frames 50 for varying the pressure between the inking cylinder 108 and the plate cylinder 106. To this end, a pair of mounting arms 172 are pivotally coupled to the respective side frames 50 and pivotal about pivot point 174 (see FIG. 7). The shaft 176 of the inking cylinder 108 is rotationally received in a bearing in each of the mounting arms 172. Advantageously, the respective side frames 50 present an enlarged opening through which distal ends of the shaft 176 extend. Advantageously, the shaft 176 on the work side 54 presents a gear 178 fixed thereto in operative mesh with the complemental gear of the plate cylinder 106. Thus, rotation of the plate cylinder 106 in turn rotates the inking cylinder 108 through the operative mesh of the work side gears. Conversely, operation of the pneumatic clutch 160 will disable rotation of the plate cylinder 106, thereby stopping rotation of the inking cylinder 108.

Turning to FIG. 7, it is seen that the respective mounting arms 172 present an elongated lever portion 180 extending towards the feed end 14 of the apparatus 10. An adjustable screw stop 182 is secured to each side frame 50 and positioned above the lever 180, while a pneumatic control 184 is mounted to the respective side frames 50 in operative lever 180. Therefore, it will be appreciated that operation of the controls 184 pivots the arms 172 about pivot points 174; this pivoting action in turn aids in the adjustment of the pressure between cylinders 106, 108.

As seen in FIGS. 4, 6, 8, to each side frame 50 is mounted a pair of upwardly extending cylindrical rods (or spindles) 186. Preferably, the uppermost ends of the respective rods 186 present a worm screw arrangement. Turning to FIG. 10, a positioning mechanism 188 is partially shown. Positioning mechanism 188 includes an electric motor 190 operatively coupled via appropriate shafts 192 and gear box 194 to a pair of worm screw transmissions 196. FIG. 10 depicts the positioning mechanism 188 for the gear side 52 only, it being understood that the work side 54 is identical in all details. It will be appreciated that the rods 186 extend upwardly in operative engagement into the respective worm screw transmissions 196. It will be appreciated that operation of the motor 190 rotates the shafts 192, in turn raising or lowering the print station 24. Each print station 24, 26 is powered from the main power transmission of the device 10. In the preferred embodiment, a power gear (not shown) is meshed with drive gear 132 to continuously rotate gear 132. Advantageously, the power gear is connected to the main power transmission by way of a gear box and telescoping rod drive shaft, allowing the gear 132 to be rotated with the print mechanism lowered or raised.

In operation, the manufacturing apparatus 10 of the present invention functions to position the printing mechanisms 34 as desired. Thus, both printing stations 24, 26 can be raised by operation of the positioning mechanism 188 to operative disposition along the path of travel for printing the sheets 12 as they serially pass therethrough. Those skilled in the art will appreciate that with both printing stations 24, 26 in the raised position, two color printing is possible, and indeed, multiple printing stations can be added to the device 10 as desired. As shown in FIG. 1, the first printing station 24 has been lowered with the conveying means 22 positioned along the path of travel for maintaining the movement of the sheets 12 along the path of travel. With the printing station 24 in the lowermost position, it is desirable to have the conveying mechanism 22 operable, and the printing mechanism 34 rendered inoperable, to allow work or maintenance functions to be performed on the printing mechanism 34.

Turning to FIGS. 2–9, the arrangement of the preferred embodiment allows the printing station 24 to be operated as desired. That is, driving gear 132 of the blanket cylinder 104 is continuously powered by the main drive transmission of the apparatus 10. Rotation of the driving gear 132, rotates the pulley 134 with the belt 75 provided to interconnect the pulley 134 with the pulley 74 of the conveying means 22. It will be appreciated that the belt 75 continuously powers the conveying mechanism 22, thereby continuously rotating the respective cylinders 60, 62. Further, it should be evident from the description that the gear 120 of the impression cylinder 102 and the gear 158 of the plate cylinder 104 likewise continually rotate because of their operable mesh with gear 132. However, the clutch 124 allows the impression cylinder 102 to be rotated or disengaged as desired. Likewise, the clutch 160 allows the plate cylinder 106 to be rotated or disengaged as desired. It will be remembered that cylinder 106 and 108 are in continuous operable mesh and operate together. Additionally, it will be appreciated that with the cylinder 60 continuously rotating, activation of the electromagnetic clutch assembly 90 drives the pulley 92 and the belt 94. The belt 94 drives the pulley 140 in turn rotating the blanket cylinder 104. Thus, it should be appreciated that while the gears 132, 120, 158 continuously rotate, the clutches 124, 160, 90 allow the cylinders 102, 104, 106, and 108 to be selectively powered or deactivated.

Thus, turning back to FIG. 1, with the print station 24 lowered in the inoperable position, the clutches 124, 160, 90 are actuated to stop rotation of the cylinders 100–108. In this position, a worker can approach the printing mechanism 34 of station 24 from the work side 54 either to perform maintenance thereon or change the print mechanism 34 according to the requirements of the next job.

That is, with the cylinders 100–108 stopped, the impression plate blaket and/or ink can be changed over to the requirements of the next succeeding job. Advantageously, in the lowered position, the conveying mechanism 22 is still powered and therefore conveys the sheets 12 serially along the path of travel through the apparatus 10. Thus, the apparatus 10 can operate while work is performed on the print mechanism 34 of station 24.

It should be understood that while the preferred embodiment contemplates two print stations as the operable work means, a wide variety of alternative native embodiments are contemplated by the present invention. For example, more than two print stations could easily be employed in the apparatus 10 of the present invention. Alternatively, the shiftable work means 20 need not necessarily be a printing mechanism, but rather might well be a punching, cutting or other manufacturing mechanism associated with processing carboard sheets. Additionally, it will be realized that although the preferred embodiments contemplate manufacturing serially moving separated sheets, the apparatus 10 is easily adaptable for operation on a continuously moving web.

Still another embodiment of the present invention would be a rearrangement of the transportation means 18 of the present invention. While the preferred embodiment contemplates using shaft pairs 36 spaced apart for serially conveying the sheets 12 along the path of travel, alternative transportation means are readily apparent. Thus, for example, short segments of closed loop conveying belts could easily be utilized in place of the shaft pairs 36. That is, viewing FIG. 1, a closed loop conveying belt could be disposed along the path of travel between the respective printing stations 24, 26 if desired.

Similarly, a wide variety of alternatives exist for conveying means 22 of the preferred embodiment. That is, cylinders 60, 62 of the preferred embodiment need not necessarily be rigidly secured to the side frames 50 for simultaneous movement with the printing mechanism 34. That is, the cylinders 60, 62 could be mounted on a pivot arm assembly for pivoting into the position vacated by the printing mechanism 34 when it is lowered. Still another alternative within the scope of the present invention, would be the use of a closed loop conveying belt in place of the conveying means 22. In such an arrangement, the conveying belt might be normally located adjacent the printing mechanism 34 when the mechanism 34 is operating, and when the mechanism 34 is lowered, the belt might be laterally shifted into the space vacated thereby.

I claim:

1. An apparaus for performing a manufacturing operation on a plurality of generaly flat, separated sheets and for moving the sheets generally along a path of travel, said apparatus comprising:

means for transporting said separated sheets serially along said path of travel between a sheet entry point and a first location and between said first location and a sheet exit point;

work means disposed along said path of travel normally at said first location and operable for moving said sheets along said path of travel at said first location and for performing the desired manufacturing operation on each sheet as it passes said first location, said work means being shiftable from said first location to a second location, said work means not performing said manufacturing operation when in said second location; and conveying means disposed along said path of travel and shiftable to said first location for conveying said sheets along said path of travel at said first location when said work means is in said second location, said conveying means being shiftabele from said first location to a third location when said work means is in said first location.

2. An apparatus as set forth in claim 1, including means for operatively coupling said work means and said conveying means for shifting said conveying means from said third location to said first location when said work means is shifted from said first location to said second location.

3. An apparatus as set forth in claim 1, said transport means comprising a plurality of elongated shafts longitudinally oriented generally transverse to said path of travel.

4. An apparatus as set forth in claim 3, said shafts being rotatable and arranged generally in juxtaposed, parallel pairs with said path of travel passing through the nip between said shaft pairs.

5. An apparatus as set forth in claim 4, said pairs of shafts being operatively spaced along said path of travel for passing said sheets between adjacent pairs of shafts.

6. An apparatus as set forth in claim 1, said conveying means comprising an elongated roller longitudinally oriented generally transverse to said path of travel.

7. An apparatus as set forth in claim 1, said conveying means comprising a pair of juxtaposed, generally parallel elongated rollers longitudinally oriented generally transverse to said path of travel and when shifted to said first location said path of travel passing through the nip between said rollers.

8. An apparatus as set forth in claim 1, said conveying means comprising one or more elongated belts oriented generally parallel to said path of travel when shifted to said first location.

9. An apparatus as set forth in claim 1, said second and third locations being spaed from said path of travel.

10. An apparatus as set forth in claim 1, said work means comprising means for performing a punching operation on said sheets.

11. An apparatus as set forth in claim 1, said work means comprising means for performing a cutting operation on said sheets.

12. An apparatus as set forth in claim 1, said work means comprising means for printing a portion of at least one face of said sheets.

13. An apparatus as set forth in claim 1, said apparatus presenting a second work means normally disposed along said path of travel at a fourth location separate from said first location, said second work means operable for moving said sheets along said path of travel at said fourth location and for performing the desired manufacturing operation on each sheet as it passes said fourth location, said second work means being shiftable from said fourth location to a fifth location, said second work means performing said manufacturing operation when in said fifth location.

14. An apparatus as set forth in claim 13, said apparatus presenting a second conveying means disposed along said path of travel and shiftable to said fourth location for conveying said sheets along said path of travel at said fourth location when said second work means is in said fifth location, said second conveying means being shiftable to a sixth location when said second work means is in said fourth location.

15. An apparatus for printing and punching a plurality of separate, cardboard pieces and for transporting the pieces serially in a direction of movement, said apparatus comprising:

means for conveying said pieces serially in said direction of movement;

first and second printing mechanisms operatively disposed successively in said direction of movement, each printing mechanism having an impression and counterimpression cylinder;

a punching mechanism operatively disposed along said direction of movement and having upper and lower rotary punching cylinders; and means for shifting each of said printing and punching mechanisms generally transverse to said direction of movement, each shifting means including a pair of elongated, spaced-apart, vertically-oriented rails adjacent respective distal ends of said cylinders, and an elongated threaded spindle operatively coupled to the respective mechanism and oriented generally transverse to said direction of movement.

16. An apparatus as set forth in claim 15, said conveying means including a plurality of elongated, shaft pairs arranged successively in said direction of movement.

17. An apparatus as set forth in claim 15, including means operatively disposed along said direction of movement for cutting said pieces to the desired size.

18. An apparatus as set forth in claim 15, including shiftable means operably positionable at the approximate location of one of said mechanisms when said one mechanism is shifted away from said direction of movement, said shiftable means operable for conveying said pieces when shifted to said location.

19. An apparatus as set forth in claim 18, said shiftable conveying means presenting a pair of juxtaposed, elongated, parallel rollers.

20. An apparatus as set forth in claim 19, said rollers being mounted to a pivotal arm and said arm connected to a worm wheel.

21. A method for manufacturing a plurality of generally flat, separated sheets comprising:

transporting said sheets serially along a path of travel to a first location;

providing a device for performing the desired manufacturing operation and for passing said sheets therethrough;

shifting said device into said first location when it is desired to perform said manufacturing operation on said moving sheets;

performing the manufacturing operation on said sheets when the device is in said first location;

providing a shiftable conveying mechanism for moving said sheets;

shifting said device out of said first location when it is desired not to perform said manufacturing operation;

shifting said conveying mechanism into said first location when said device is not in said first location; and moving said sheets along the path of travel at the first location when said conveying mechanism is in said first location.

22. A method as set forth in claim 21, including the steps of:

transporting said sheets serially along a path of travel from said first location to a second location;

providing a second device for performing the desired manufacturing operation;

shifting said second device into said second location when it is desired to perform said manufacturing operation on said moving sheets;

providing a second shiftable conveying mechanism for moving said sheets when presented to said mechanism;

shifting said second device out of said second location when it is desired not to perform said manufacturing operation at said second location; and shifting said second conveying mechanism into said second location when said second device is not in said second location for moving said sheets along the path of travel at said second location.

* * * * *